US005957607A

United States Patent [19]

Tsai

[11] Patent Number: 5,957,607

[45] Date of Patent: Sep. 28, 1999

[54] COSMETIC PENCIL STRUCTURE

[76] Inventor: Felix J. Tsai, Rm.1400,14/F, No.1, Fu Hsing South Rd., Sec. 1, Taipei, Taiwan

[21] Appl. No.: 09/098,836

[22] Filed: Jun. 17, 1998

[51] Int. Cl.[6] ..... B43K 5/12

[52] U.S. Cl. ..... 401/194; 401/192

[58] Field of Search ..... 401/194, 192, 401/88, 89, 49, 52

[56] References Cited

U.S. PATENT DOCUMENTS

| | | | |
|---|---|---|---|
| 13,900 | 3/1855 | Hahn | 401/194 |
| 2,238,447 | 2/1941 | Lefebvre | 401/98 |
| 2,595,403 | 5/1952 | Neuschaefer | 401/194 |
| 4,579,134 | 4/1986 | Moore | 401/192 |

*Primary Examiner*—David J. Walczak
*Attorney, Agent, or Firm*—Pro-Techtor International Services

[57] ABSTRACT

A cosmetic pencil structure in which a transparent tail cap is inserted into a central hole of the main body at a tail end thereof. The tail cap has an inner cavity, whereby when filling the lipstick paste into the central hole of the main body, the lipstick paste is also filled into the cavity of the tail cap, so that the transparent tail cap will show the same color as the lipstick paste in the main body without taking off the front cap. Therefore, a consumer can easily select a necessary cosmetic pencil without troublesome comparison.

3 Claims, 6 Drawing Sheets

COSMETIC PENCIL STRUCTURE

BACKGROUND OF THE INVENTION

The present invention relates to a cosmetic pencil structure which is applicable to a lipstick pencil, lipliner pencil, eyeshadow pencil, rouge pencil and eyebrow pencil, etc. The cosmetic pencil has a transparent tail cap inserted in a central hole of a main body of the cosmetic pencil at a tail end thereof. The transparent tail cap shows the true color of the lipstick paste without taking off the front cap.

In order to facilitate selection of a lipstick for a consumer, conventionally, a color similar to that of the lipstick is painted on a shaft of the lipstick for the consumer to choose necessary lipstick. Some shortcomings exist in such arrangement as follows:

1. The material of the paint is different from the material of the lipstick so that the paint can hardly accurately show the true color of the lipstick.
2. The lipstick is a solid bar, while the thickness of the paint layer can be hardly controlled so that the paint varies from thick to thin color. Therefore, the paint can hardly truly reflect the color of the lipstick.
3. The shaft of the lip pencil is made of PVC foam material which is subject to thermal deformation. Therefore, it is impossible to quickly heat and dry the paint after painted on the shaft and the paint must be naturally dried. The lipstick products must be collected after the paint is naturally dried. Therefore, the operation time is prolonged and the uncollected lipsticks will occupy much room.

FIGS. 6 and 7 show an improved design of the lipstick in which a rear end B of the main body A of the lip pencil is made as a plastic cap formed by plastic injection molding. This improves the shortcomings of the above lipstick. However, there are still some disadvantages existing in such arrangement as follows:

1. Prior to the injection molding operation, a color is mixed with the plastic material (which is originally transparent). It is difficult to accurately control the amount of the color mixed with the plastic material so that the color of the rear plastic cap B can hardly truly show the color of the lipstick.
2. Each time manufacturing different colors of rear caps B, it is necessary to wash the material container and material pipe. This is time-consuming and laborious.

FIGS. 8 and 9 show still another improved lipstick product in which the tail cap and the main body of the lip pencil have the same color, while the front cap D of the main body C is transparent. This permits a consumer to clearly see the color of the lipstick. However, some shortcomings still exist in such arrangement as follows:

1. The front cap D serves to protect the head of the lip pencil. However, when placed on a shelf, the lipstick is exposed to indoor light or outdoor light and is subject to deterioration. Therefore, the using life of the lipstick is shortened.
2. The transparent front cap D gives a rough feeling without high quality.

SUMMARY OF THE INVENTION

In order to obviate the above problems, it is a primary object of the present invention to provide a cosmetic pencil structure in which a transparent tail cap is inserted into a central hole of the main body at a tail end thereof. The tail cap has an inner cavity, whereby when filling the lipstick paste into the central hole of the main body, the lipstick paste is also filled into the cavity of the tail cap, so that the transparent tail cap will show the same color as the lipstick paste in the main body. Therefore, the lip pencil can be placed on a shelf for a consumer to easily select the necessary one without troublesome comparison work.

It is a further object of the present invention to provide the above cosmetic pencil which is easily manufactured and assembled to save working time and labor. The number of the tail caps with the same color as the lip pencil is equal to the number of the lip pencils so that the production can be automatized to reduce cost.

It is still a further object of the present invention to provide the above cosmetic pencil in which the transparent tail cap can truly show the color of the lipstick without taking off the front cap so that the lipstick is protected from deterioration and the lipstick is durable.

The present invention can be best understood through the following description and accompanying drawings, wherein:

DETAILED DESCRIPTION OF THE PREFERRED EMBODIMENTS

Figure 1:
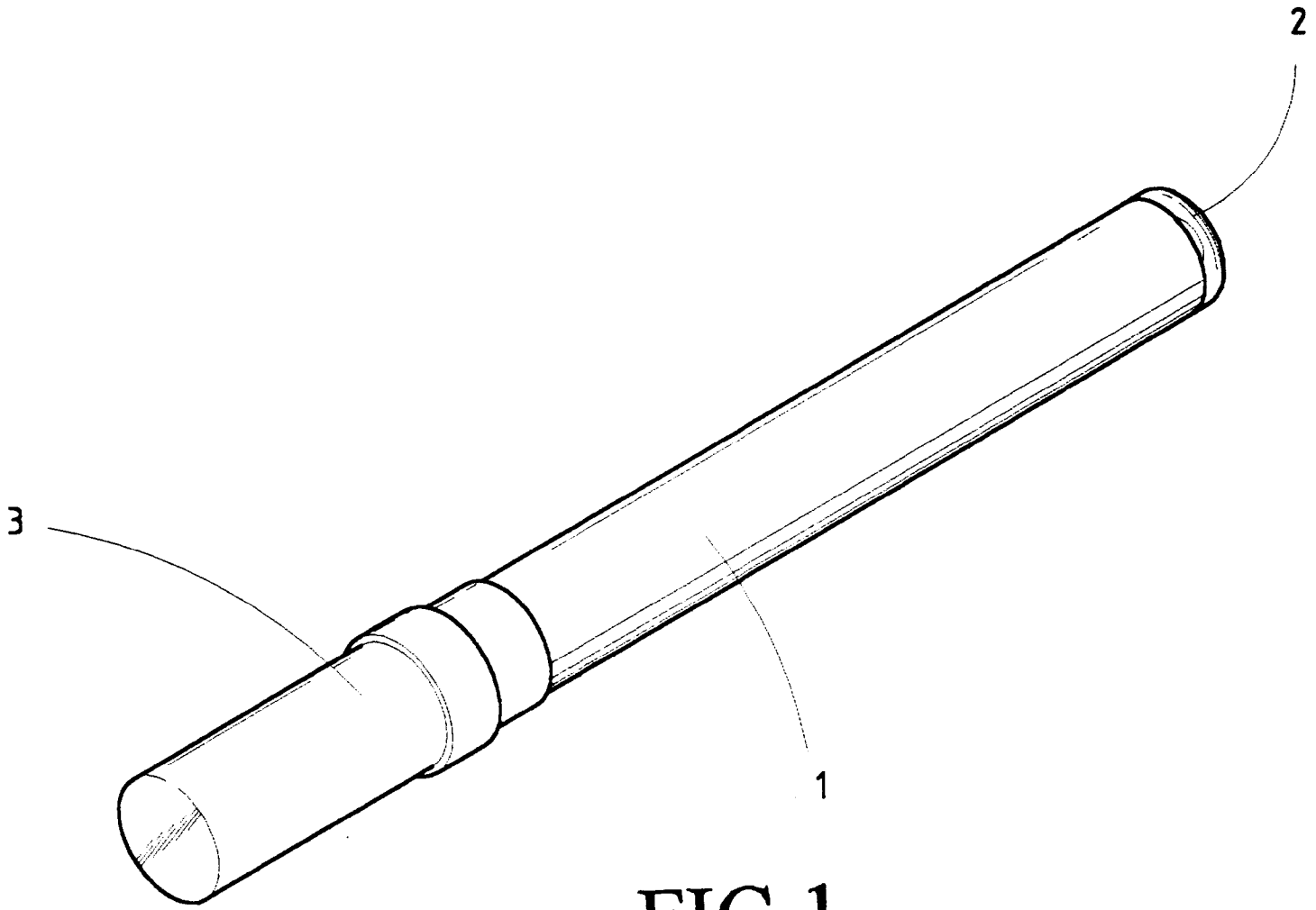
FIG. 1 is a perspective assembled view of the present invention.
Figure 2:
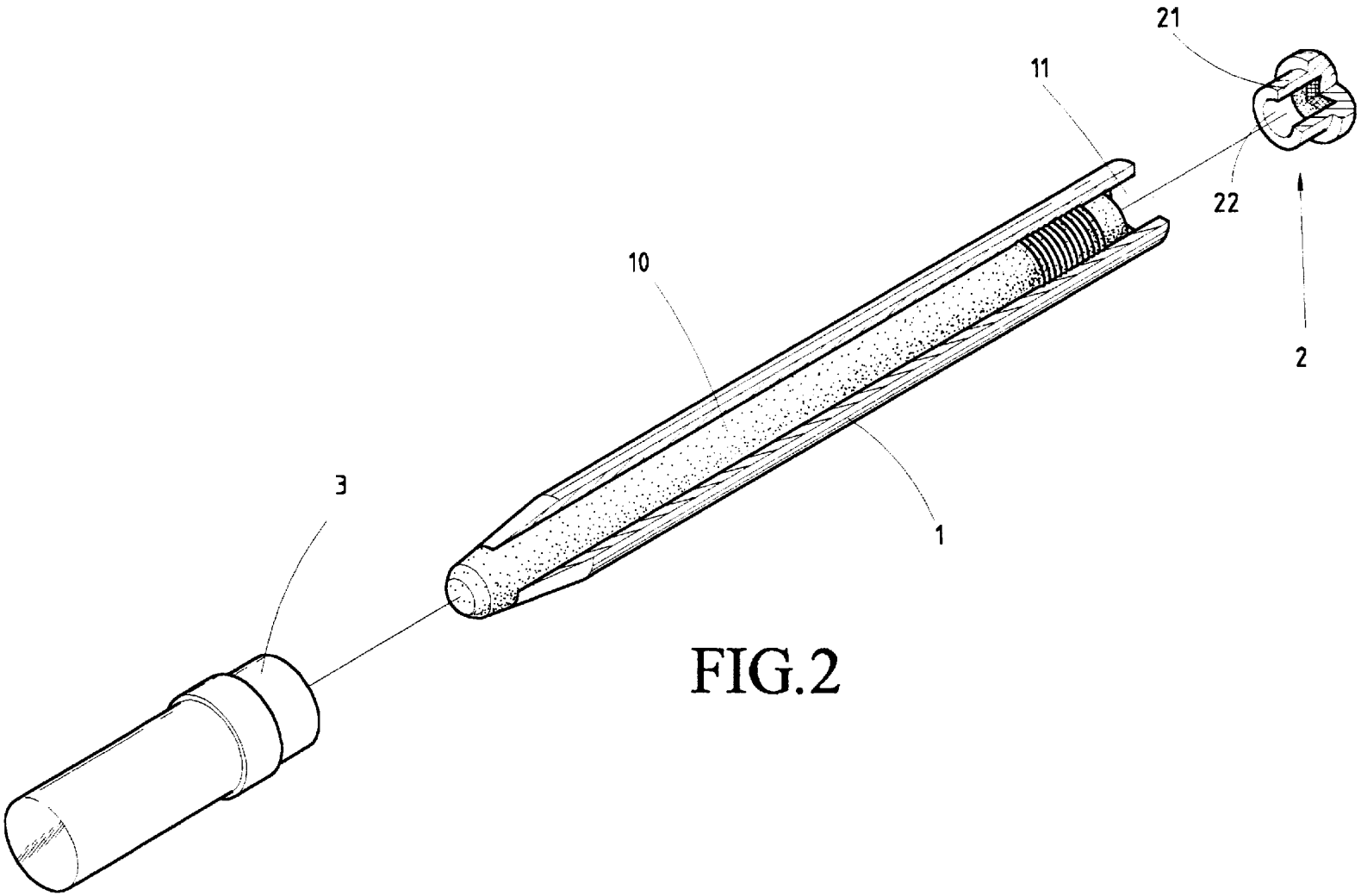
FIG. 2 is a perspective exploded view of the present invention.
Figure 3:
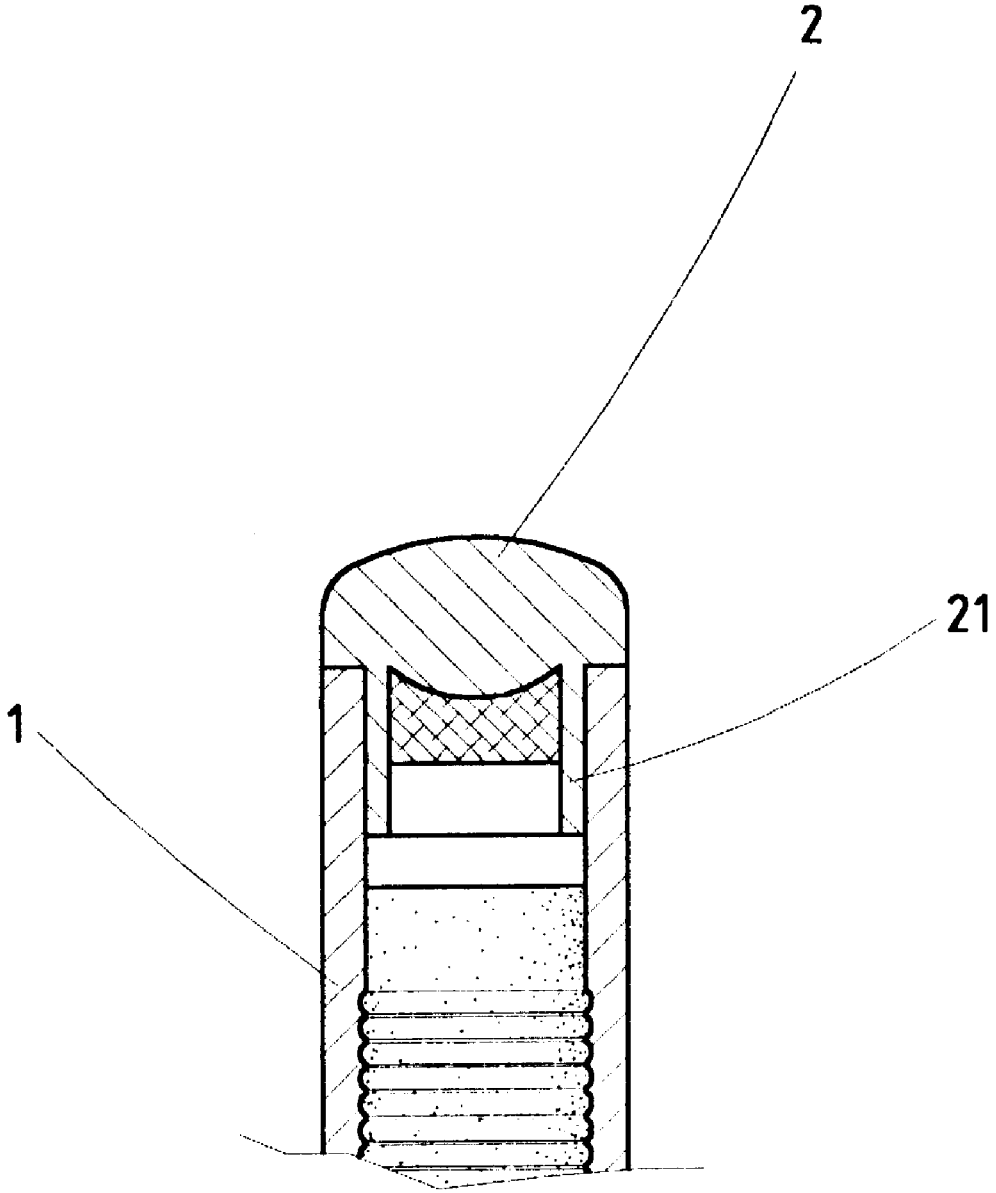
FIG. 3 is a sectional view of the tail cap of the cosmetic pencil of the present invention.

Please refer to FIGS. 1 to 3. The present invention includes a main body 1, a tail cap 2 and a front cap 3. The main body 1 is a pen-like rod body having a central hole 11 for filling therein lipstick paste 10 (or other cosmetic paste material). The front cap 3 is fitted with a front end of the main body 1. The tail cap 2 has a boss 21 for fitting into the central hole 11 of the main body 1 from a tail end thereof. The tail cap 2 is transparent, having an inner cavity 22. When filling the lipstick paste 10 into the central hole 11 of the main body 1, the lipstick paste is also filled into the cavity 22 of the tail cap 2, so that the transparent tail cap 2 will show the same color as the lipstick paste 10 in the main body 1.

Figure 4:
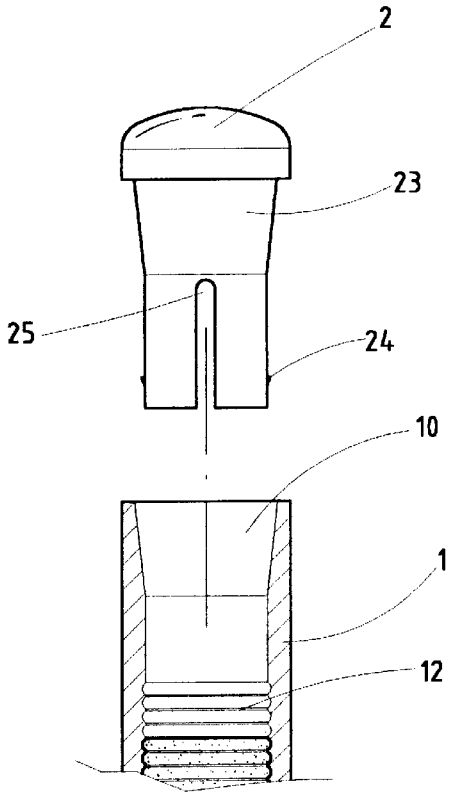
FIG. 4 is a sectional exploded view of a preferred embodiment of the tail cap and tail end of the main body of the cosmetic pencil of the present invention.
Figure 5:
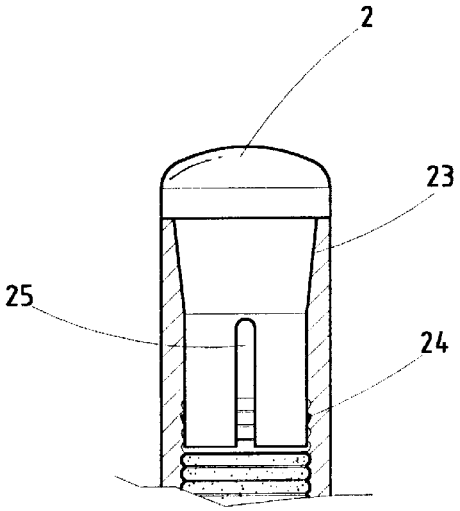
FIG. 5 is a sectional assembled view according to FIG. 4.
Figures 6, 7:
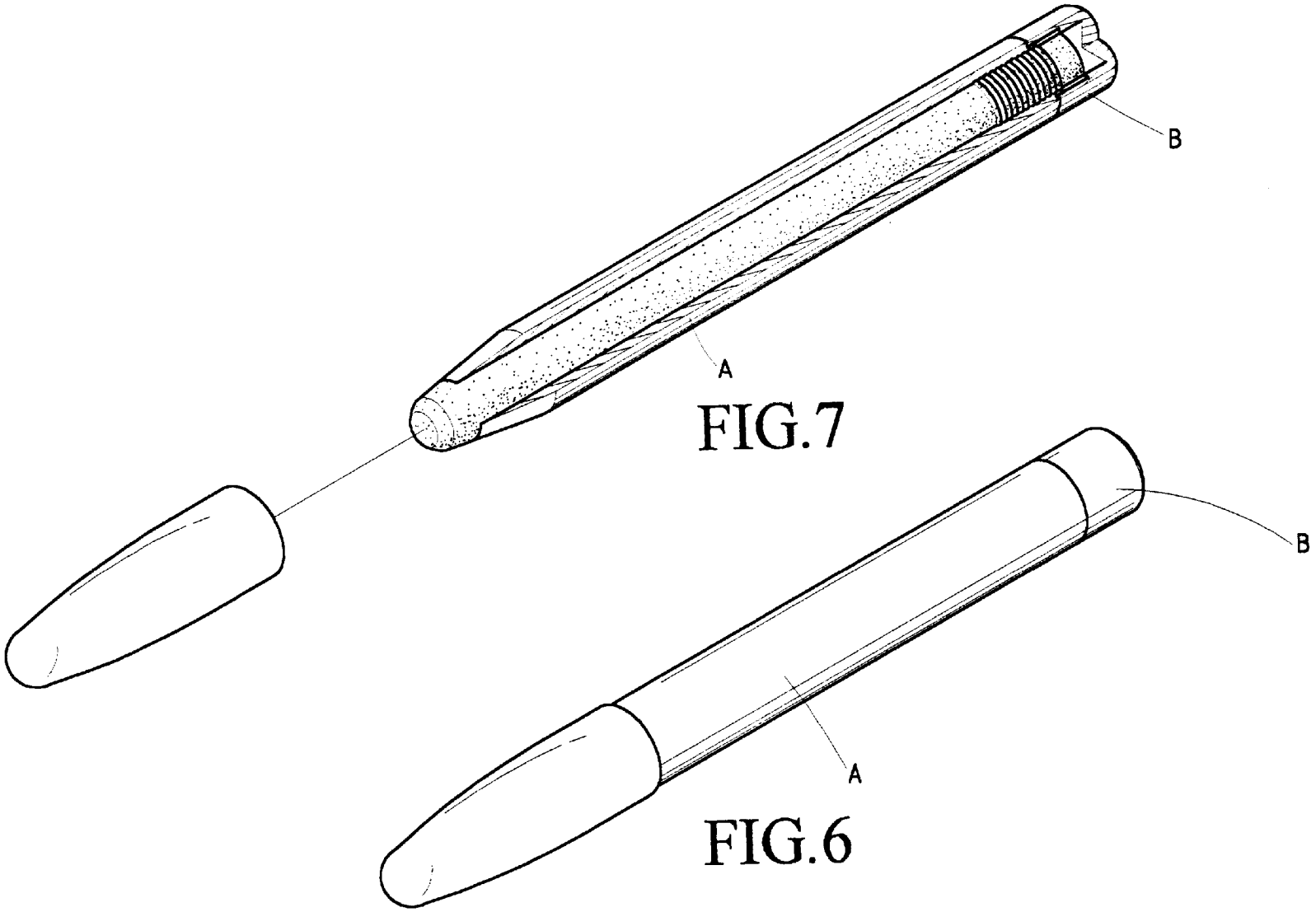
FIG. 6 is a perspective assembled view of a conventional cosmetic pencil.
FIG. 7 is a perspective exploded view of the conventional cosmetic pencil.
Figure 9:
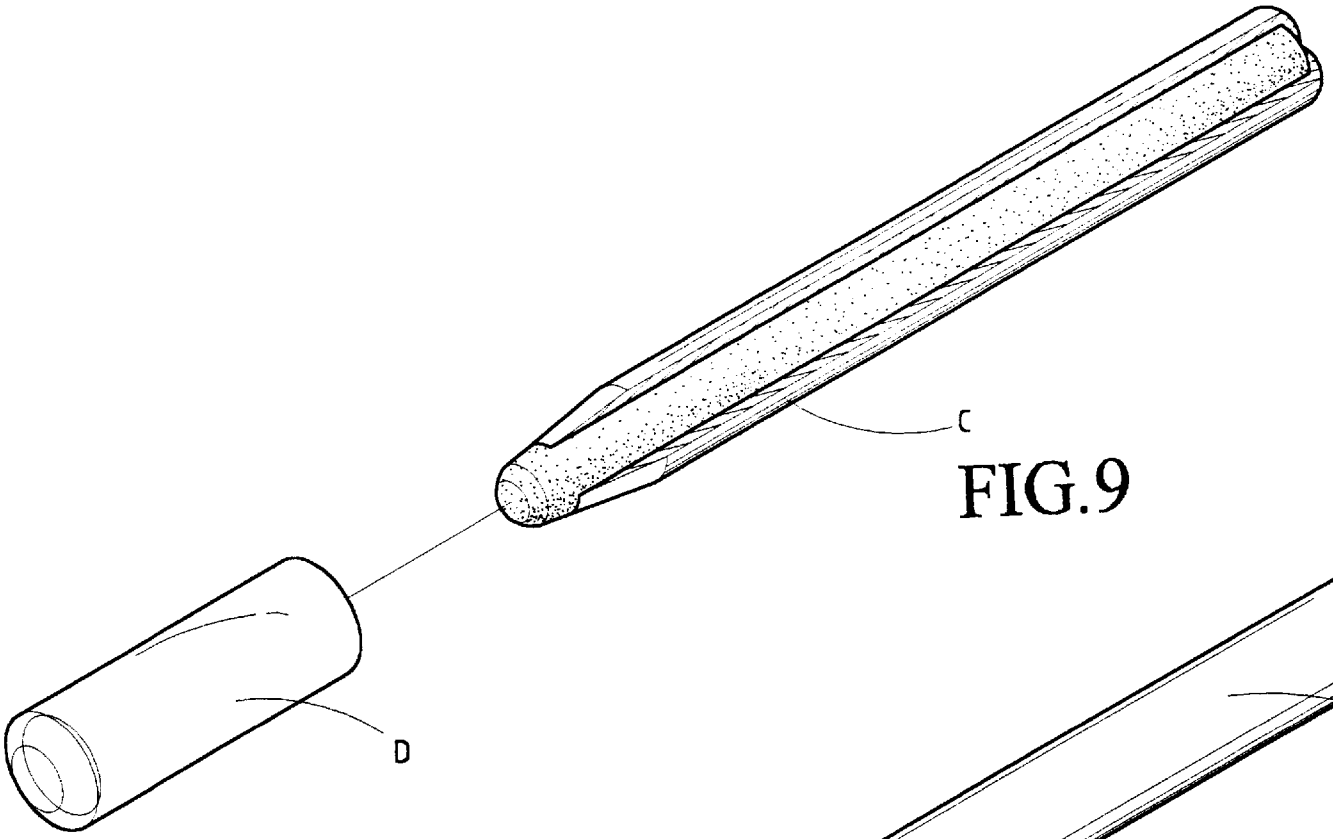
FIG. 9 is a perspective exploded view of the conventional cosmetic pencil of FIG. 8.
Figure 8:
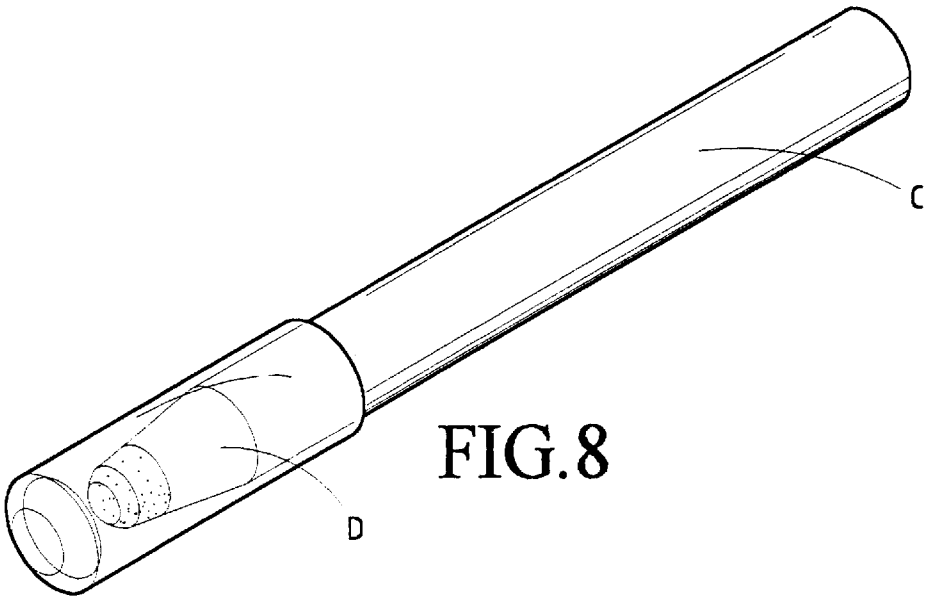
FIG. 8 is a perspective assembled view of another conventional cosmetic pencil.

Referring to FIGS. 4 and 5, in a preferred embodiment of the present invention, the central hole 11 at the tail end of the main body 1 is formed as a conic hole and the boss 23 of the tail cap 2 is also conic for tightly fitting into the central hole 11. The boss 23 of the tail end 2 is disposed with two lateral tenons 24 spaced by two fissures 25. When the boss 23 is inserted into the central hole 11 of the main body 1, the fissures 25 adjusts the resilience of the boss 23 for easily inserting into the central hole 11. The two tenons 24 are respectively inserted into a threaded section 12 of the central hole 11. This makes it easy to fit in the boss 23 of the tail cap 2, while uneasy to extract out the boss 23 of the tail cap 2.

Therefore, the tail cap 2 is tightly engaged with the tail end of the main body 1.

The present invention is also applicable to lipline pencil, eyeshadow pencil, rouge pencil and eyebrow pencil, etc. According to the above arrangement, the present invention has the following advantages:

1. The cosmetic pencil of the present invention has beautiful appearance for attracting a consumer.
2. The lipstick paste material is kept fresh in the cosmetic pencil and is durable.
3. The troublesome comparison of the color of the cosmetic pencil with the other is unnecessary.
4. The manufacturing and assembling procedure is simplified to save labor and time. Also, the production can be automatized to reduce cost.

It is to be understood that the above description and drawings are only used for illustrating one embodiment of the present invention, not intended to limit the scope thereof. Any variation and derivation from the above description and drawings should be included in the scope of the present invention.

What is claimed is:

1. A cosmetic pencil structure comprising:

main body, a tail cap, and a front cap, said main body being formed with a central hole adapted to receive lipstick paste material therein, said front cap being fitted onto a front end of said main body, said tail cap has a boss that is inserted into said central hole of said main body from a tail end thereof, said tail cap being transparent and having an inner cavity in communication with said central hole of said main body, whereby when lipstick paste is loaded into said central hole of said main body, the lipstick paste also fills into said cavity of said tail cap, so that a color of the lipstick paste in said main body is visible through said tail cap.

2. The cosmetic pencil structure as claimed in claim 1, wherein:

said central hole at said tail end of said main body is formed as a conic hole and said boss of said tail cap is also conic to thereby fit securely into said central hole of said main body.

3. The cosmetic pencil structure as claimed in claim 1, wherein:

said boss of said tail cap includes two lateral tenons spaced by two fissures, such that said boss of said tail cap is easily inserted into said central hole of said main body, and said boss of said tail cap is difficult to extract from said central hole of said main body.

* * * * *